US011572266B2

(12) United States Patent
Ravindran et al.

(10) Patent No.: US 11,572,266 B2
(45) Date of Patent: Feb. 7, 2023

(54) BEVERAGE DISPENSERS CONFIGURED FOR FRONT SERVICEABILITY

(71) Applicants: Marmon Foodservice Technologies, Inc., Osseo, MN (US); The Coca-Cola Company, Atlanta, GA (US)

(72) Inventors: Shishirdas Kasaragod Ravindran, Kasaragod (IN); Mark Miller, Villa Park, IL (US); Dusan N. Ivancevic, Carol Stream, IL (US); Fernando Jose Aguilar Harrison, Chicago, IL (US); Zersis Mehta, Lawrenceville, GA (US); Tim Blevins, Powder Springs, GA (US); Kenyon Hall, Suwanee, GA (US)

(73) Assignees: Marmon Foodservice Technologies, Inc., Osseo, MN (US); The Coca-Cola Company, Atlanta, GA (US)

( * ) Notice: Subject to any disclaimer, the term of this patent is extended or adjusted under 35 U.S.C. 154(b) by 0 days.

(21) Appl. No.: 17/357,199

(22) Filed: Jun. 24, 2021

(65) Prior Publication Data

US 2021/0403307 A1 Dec. 30, 2021

(51) Int. Cl.
*B67D 1/08* (2006.01)
*B67D 1/00* (2006.01)

(52) U.S. Cl.
CPC .... *B67D 1/0888* (2013.01); *B67D 2001/0095* (2013.01)

(58) Field of Classification Search
CPC ..... B67D 1/0888; B67D 2001/0095; B67D 1/0892; B67D 2210/00034
See application file for complete search history.

(56) References Cited

U.S. PATENT DOCUMENTS

| | | | | |
|---|---|---|---|---|
| 3,528,587 | A | 9/1970 | Popinski | |
| 4,493,441 | A * | 1/1985 | Sedam | F25B 21/02 62/390 |
| 4,615,466 | A * | 10/1986 | Credle, Jr. | B67D 3/0019 137/240 |
| 4,679,707 | A * | 7/1987 | Sedam | F25B 21/02 222/325 |
| 6,182,555 | B1 * | 2/2001 | Scheer | A47J 31/40 99/290 |
| 9,102,508 | B2 * | 8/2015 | O'Keefe, Jr. | B67D 1/0004 |
| 9,656,849 | B2 | 5/2017 | Hawken | |

(Continued)

FOREIGN PATENT DOCUMENTS

| | | | | |
|---|---|---|---|---|
| KR | 20160000272 U | * | 1/2016 | B67D 1/0888 |
| WO | WO-2013063463 A1 | * | 5/2013 | B67D 1/0878 |
| WO | 2019246413 A1 | | 12/2019 | |

*Primary Examiner* — Donnell A Long
(74) *Attorney, Agent, or Firm* — Andrus Intellectual Property Law, LLP

(57) ABSTRACT

A beverage dispenser configured for servicing from the front. A front cover is coupled to a cabinet and positionable in open and closed positions. A housing is positioned in an interior of the cabinet and supports cartridges containing ingredients for dispensing a beverage. The housing at least partially defines a cavity within the interior of the cabinet. An electronics box is configured for coupling to the cabinet in an operating position within the cavity and also in a service position in front of the housing. The cavity is accessible from the front of the cabinet when the front cover is in the open position and the electronics box is in the service position.

20 Claims, 9 Drawing Sheets

(56) References Cited

U.S. PATENT DOCUMENTS

| | | | | |
|---|---|---|---|---|
| 10,221,058 | B2 | 3/2019 | Dresser et al. | |
| 10,384,920 | B2 * | 8/2019 | Henriquez | B67D 1/0007 |
| 10,390,653 | B2 | 8/2019 | Lussi et al. | |
| 10,399,842 | B2 * | 9/2019 | Henriquez | B67D 1/0086 |
| 10,544,027 | B2 | 1/2020 | Gatipon et al. | |
| 2004/0216474 | A1 * | 11/2004 | Jablonski | F25C 1/12 222/146.6 |
| 2006/0180610 | A1 * | 8/2006 | Haskayne | B67D 1/0888 222/129.1 |
| 2009/0308494 | A1 * | 12/2009 | Linn | B67D 1/124 210/85 |
| 2010/0199709 | A1 * | 8/2010 | Holland | F25D 11/02 62/449 |
| 2012/0067076 | A1 * | 3/2012 | Schroeder | B67D 1/0003 62/306 |
| 2019/0121376 | A1 * | 4/2019 | Guilliard | B21C 35/026 |

* cited by examiner

BEVERAGE DISPENSERS CONFIGURED FOR FRONT SERVICEABILITY

CROSS REFERENCE TO RELATED APPLICATION

This application claims the benefit of Indian Patent Application No. 202021026929, filed Jun. 25, 2020, which is incorporated herein by reference in its entirety.

FIELD

The present disclosure generally relates to beverage dispensers, and more particularly to serviceability for beverage dispensers.

BACKGROUND

The following U.S. patents provide background information and are incorporated by reference in their entireties.

U.S. Pat. No. 9,656,849 discloses a valve dispensing system that can be used in a beverage dispenser. In particular, the valve dispensing system has individual valve module components that control the flow of a beverage or beverage component, and a plurality of valve module components may be combined to form a system capable of dispensing a plurality of beverages and/or beverage components.

U.S. Pat. No. 10,221,058 discloses a beverage dispensing machine that defines a service opening through which beverage dispensing equipment is accessible to an operator includes a service door on a housing that is movable between an open position, such that the beverage dispensing equipment is accessible to an operator via the service opening, and a closed position, such that the service door closes the service opening so that the beverage dispensing equipment is inaccessible to the operator. A display panel on the service door displays operational characteristics of the beverage dispensing equipment. When the service door is in the open position the display panel is maneuverable so that the display panel is angled towards the service opening so that an operator can view the display panel while accessing the beverage dispensing equipment via the service opening.

SUMMARY

This Summary is provided to introduce a selection of concepts that are further described below in the Detailed Description. This Summary is not intended to identify key or essential features of the claimed subject matter, nor is it intended to be used as an aid in limiting the scope of the claimed subject matter.

An example of a beverage dispenser is configured to be serviced from a front thereof. The beverage dispenser also includes a cabinet having a top opposite a bottom, a back that extends between the top and the bottom, and sides extending forwardly from the back between the top and the bottom, where an interior is defined between the top, the bottom, the back, and the sides. A front cover is coupled to the cabinet and positionable in an open position and a closed position opposite the back of the cabinet. A housing is positioned in the interior, the housing configured to receive a plurality of cartridges containing ingredients for a beverage, the housing within the interior at least partially defining a cavity within the cabinet. An electronics box houses electrical circuitry. The electronics box is configured to couple to the cabinet in the operational position at least partially within the cavity and the electronics box is configured to couple to the cabinet in a service position in front of the housing.

The beverage dispenser may include an interior floor may include a rail and when the electronics box is in the operational position a bottom of the electronics box rests upon the interior floor. The electronic box is removably secured to the rail by a first fastener. When the electronics box is in the operational position, the electronics box is secured to the lip by at least a second fastener. The second fastener secures the electronics box to the lip through the flange. The bracket further may include a hook that extends rearward past a back of the electronics box. When the electronics box is in the service position, the hook releasably secures the electronics box to the bracket secured to the lip. The beverage dispenser may include a striker secured to a front panel of the electronics box. The hinge system may include two arms connected by an arm body the two arms each movably extend between the cabinet and the front cover, and a latch, where the latch is configured to releasably secure the front cover to the striker on the front panel of the electronics box when the front cover is in the closed position. At least an electrical power cord and an electrical communication cord enter the cabinet through the first electrical connectors. At least the power cord and the electrical communication cord enter the electronics box through second electrical connectors through the electronics box. The first and second electrical connectors may be strain relief bushings. The first and second electrical connectors provide fixed points relative to the electrical power cord and the electrical communication cord. Respective lengths of the electrical power cord and the electrical communication cord are defined based upon distances between the first electrical connectors and second electrical connectors when the electronics box is in the service position. A grounding wire remains connected between the electronics box and the cabinet as the electronics box is moved between the operational position and the service position.

Another example of a beverage dispenser is configured to be serviced from a front thereof. The beverage dispenser also includes a cabinet having a top opposite a bottom, a back that extends between the top and the bottom, and first and second sides extending forwardly from the back between the top and the bottom, where an interior is defined between the top, the bottom, the back, and the first and second sides. A front cover coupled to the cabinet and positionable in an open position and a closed position opposite the back of the cabinet. A first housing is positioned in the interior adjacent the first side and the top, the housing configured to receive a plurality of ingredient cartridges. A second housing is positioned in the interior adjacent the second side and the top, the second housing configured to receive the plurality of ingredient cartridges. The first housing and the second housing at least partially define a cavity within the interior. An interior floor may include a rail supported between an interior wall and at least one of the first side or the second side. A hinge system is connected between the cabinet and the front cover and operates to move the front cover between the open position and the closed position, the hinge system includes a latch. An electronics box has a front panel and a back panel and houses electrical circuitry. The electronics box is configured to couple to the cabinet in an operational position at least partially within the cavity and supported by the rail and where the electronics box is configured to couple to the cabinet in a service position in front of the first housing. The front panel includes a striker configured to be engaged by the latch of the hinge system to removably secure the front cover in the closed position.

In the beverage dispenser, the hinge system may include two arms connected by an arm body the two arms each movably extend between the cabinet and the front cover. The front panel further may include a graphical display, and the front panel is configured to remain parallel to the closed position as the front panel moves from the closed position to the open position. The first pump bracket may include at least one first arm extending forward of the first pump bracket and configured to secure to the first housing, the first pump bracket interior the cabinet from the first pump bracket, where the first pump bracket positions the plurality of pumps connected to the first pump bracket behind the back panel of the electronics box when the electronics box is in the operational position; and where the second pump bracket may include at least one second arm extending forward of the second pump bracket and configured to secure to the second housing, the second pump bracket interior the cabinet from the first pump bracket, where the first pump bracket positions the plurality of pumps connected to the second pump bracket behind the back panel of the electronics box when the electronics box is in the operational position. The first housing and the second housing are positioned within the interior inset from the rail, where when the electronics box is in the operational position, the front panel of the electronics box is forward of the first housing and the second housing. The electronics box is configured to connect in the operational position by at least a first fastener through the flange and into the lip. The electronics box is configured to connect in the service position by engagement between the hook and the frame bracket. At least an electrical power cord and an electrical communication cord enter the cabinet through the first electrical connectors. At least the power cord and the electrical communication cord enter the electronics box through the second electrical connectors. The first and second electrical connectors are strain relief bushings that provide fixed points relative to the electrical power cord and the electrical communication cord, and respective lengths of the electrical power cord and the electrical communication cord are defined based upon a distance between the first and second electrical connectors when the electronics box is in the service position. The grounding wire remains connected between the electronics box and the cabinet as the electronics box is moved between the operational position and the service position.

BRIEF DESCRIPTION OF THE DRAWINGS

The present disclosure is described with reference to the following Figures.

DETAILED DISCLOSURE

The present disclosure generally relates to beverage dispensers, including those that incorporate cartridges of concentrated ingredients for mixing together in the beverage to be dispensed, such as provided within "micro-dosing" dispensers. The present inventors have recognized that physical space and access clearance are often constraints for such beverage dispensers being installed in restaurants, convenience stores, and other customer sites. In particular, there is often insufficient space to gain access to the sides and/or back of a beverage dispenser as necessary for service or maintenance. Moreover, physically moving the beverage dispenser to gain such access is often problematic, due in part to weight, fluid and/or electrical connections to the beverage dispenser, having sufficient space to move the beverage dispenser, and other constraints. Accordingly, the present inventors have recognized that it would be advantageous for a beverage dispenser to be serviceable entirely from the front thereof, reducing the need to move the system and thereby minimizing the down time and cost of owning a machine.

Figure 1:
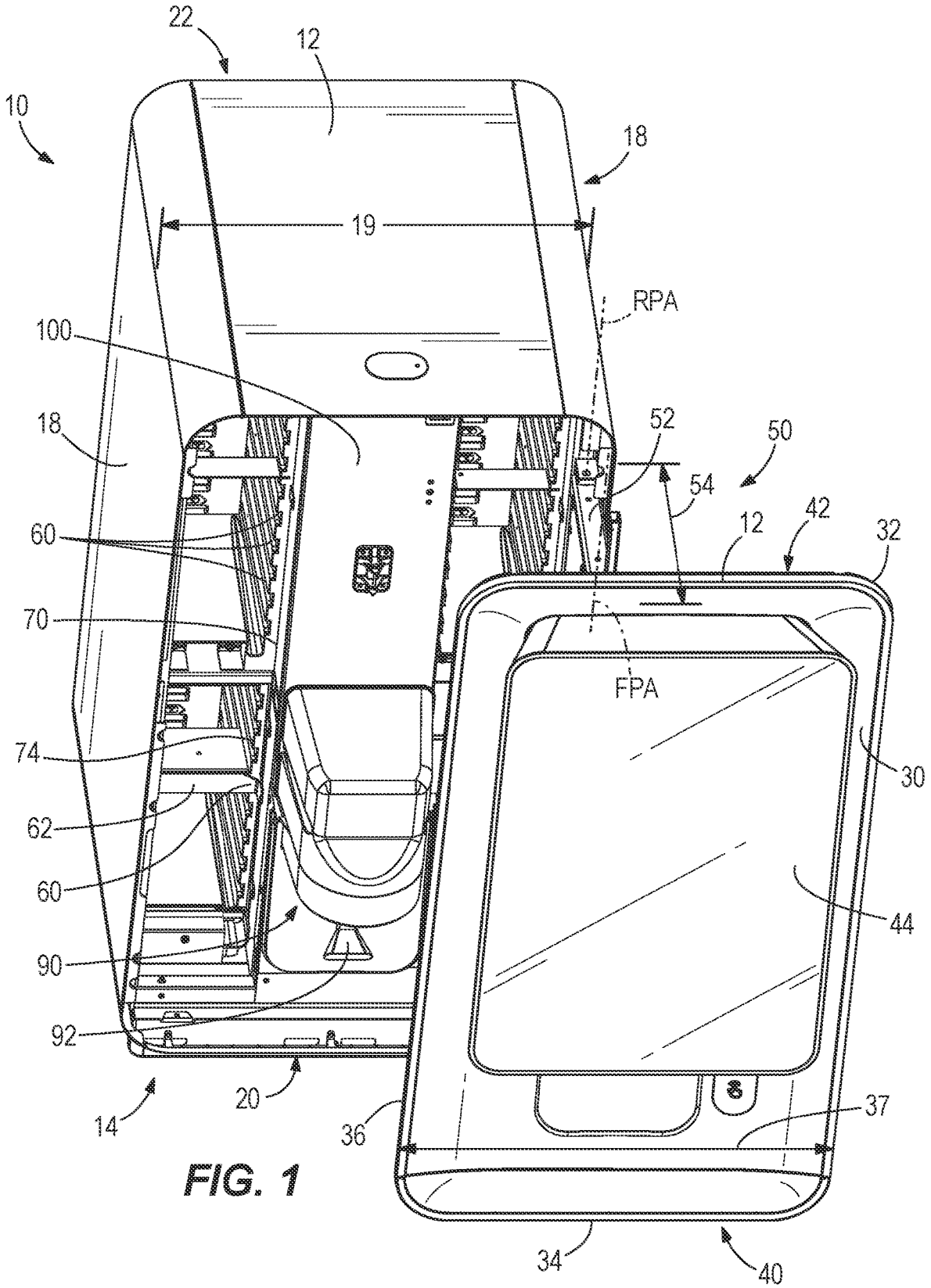
FIG. 1 depicts a front perspective view of a beverage dispenser according to the present disclosure with a front cover open.

FIG. 1 depicts an exemplary beverage dispenser 1 according to the present disclosure. The beverage dispenser 1 includes a cabinet 10 having a top 12 and bottom 14, as well as sides 18, and a back 22. The top 12, bottom 14, sides 18, and back 22 define an open interior 20 of the cabinet 10. A width 19 is defined between the sides 18. A front cover 30 movably connected to the cabinet 10 and itself has a top 32, bottom 34, sides 36, a front 40, and back 42. A width 37 is defined between the sides 36. A graphical display 44, is provided on the front 40 of the front cover 30. The graphical display 44, which may be a touch-sensitive graphical display is configured to present a graphical user interface and to receive touch inputs from an operator to enable operator interaction with the beverage dispenser 1, such as to receive an operator selection of a particular recipe (e.g., mixture of available ingredients) or size of beverage to be dispensed, or to receive operator selections of various settings of the beverage dispenser 1 for setup, maintenance, and/or the like.

With continued reference to FIG. 1, the front cover 30 is pivotally coupled to the cabinet 10 via a hinge system 50. The front cover 30 is movable between a closed position wherein the front cover 30 engages the cabinet 10 and prevents access to the interior 20 and an open position wherein the front cover is moved relative to the cabinet 10, permitting access to the open interior. When the front cover 30 is closed and the beverage dispenser 1 is on, beverages may be dispensed via dispensing hardware 90 in a customary manner (e.g., that used within the Cornelius® IDC PRO), such as upon activation of the dispensing lever 92 extending through a cutout 93 in the front cover 30.

Figure 10:
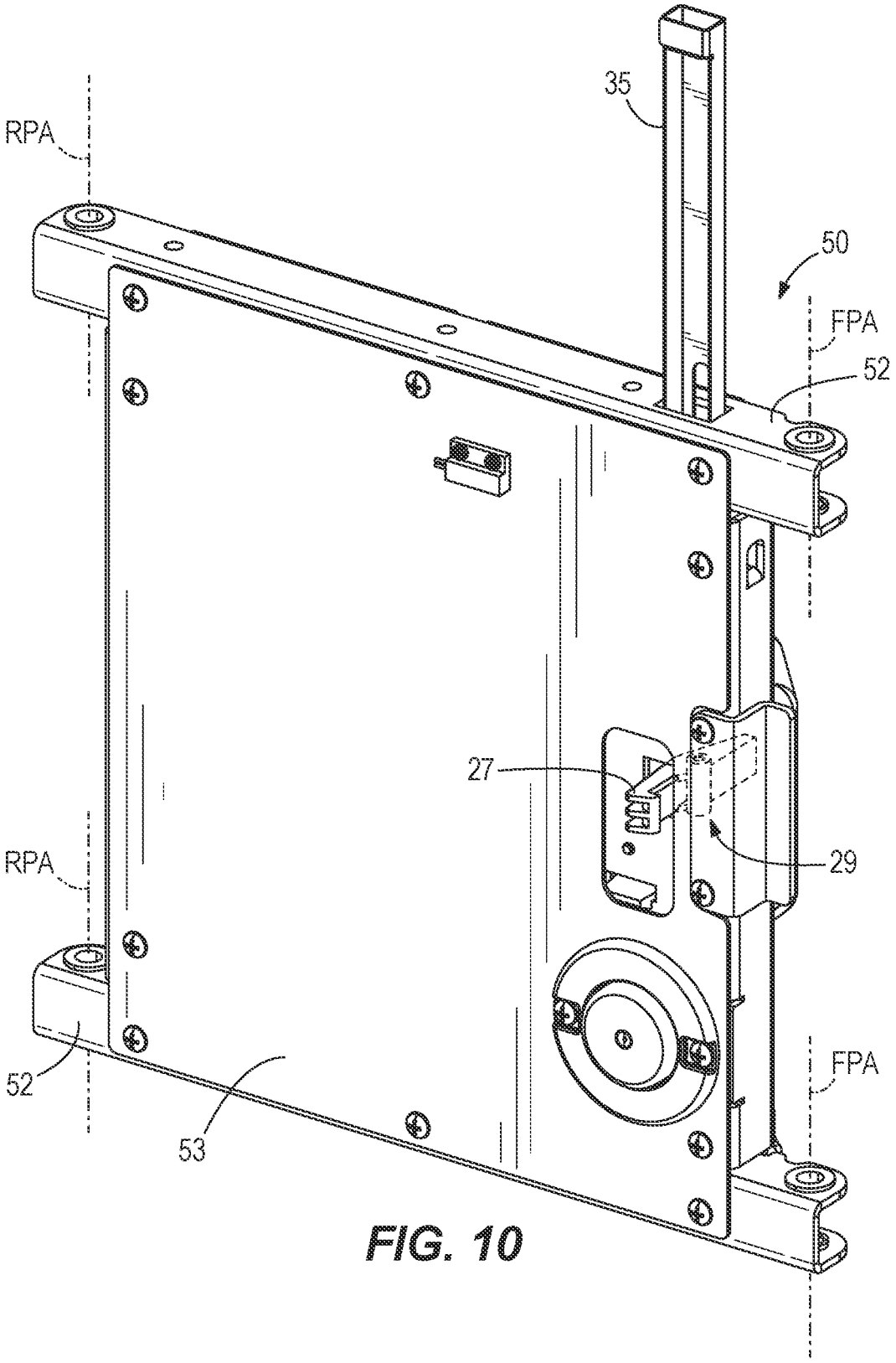
FIG. 10 is a perspective view of an example of the hinge system.

The hinge system 50 is shown in greater detail in FIG. 10 and includes one or more arms 52 each having a length 54. In the example shown, the hinge system 50 includes two arms 52 connected by a hinge body 53, forming a linkage between the cabinet 10 and the front cover 30. The arms 52 are pivotally coupled to the front cover 30 at respective pivot points defining a front pivot axis FPA. The arms 52 are pivotally coupled to the cabinet 10 at respective pivot points defining a rear pivot axis RPA. In this manner, the front cover 30 is held in a sturdy manner relative to the cabinet 10, but allows the front cover 30 to be pivoted relative to both the cabinet 10 and to the arms 52 of the hinge system 50. The flexibility of pivoting about both the front pivot axis FPA and rear pivot axis RPA allows maintenance personnel to access the open interior 20 of the cabinet 10 without requiring a substantial footprint in front and to the sides of the beverage dispenser 1. For example, the front cover 30 can pivot about the RPA, opening like a door, while in another example, the front cover 30 pivots about the FPA while also pivoting about the RPA to maintain the front cover 30 in an orientation parallel to an orientation of the front cover 30 in the closed position.

A striker 31 and latch 29 can releasably secure the front cover 30 in the closed position. An electronics box 100, as will be discussed in further detail herein, includes a front panel 110. A striker 31 is connected to the front panel 110 of the electronics box 100. The hinge system includes a latch 29 that is configured to releasably engage the striker 31 and secure the front cover 30 to the electronics box 100 in the closed position. The latch 29 exemplarily includes a catch 27 that releasably traps the striker 31. The catch 27 may be pivotably connected to the hinge body 53. The dispenser 1 includes a manual release for the latch 29. Opening 33 is provided through the top 12 of the cabinet 10. The opening 33 provides access to a rod 35 positioned within the cabinet 10 when the front cover is in the closed position. Pressing down on the rod 35 manually opens the catch 27 of the latch 29. In an example, the rod 35 may pivot the catch 27 to a position that releases the striker 31. It will be recognized that the rod 35 may be indirectly pressed, for example an operator may actuate a lever, a button, or an elastomeric membrane, the force of which is translated to the rod 35.

Figure 2:
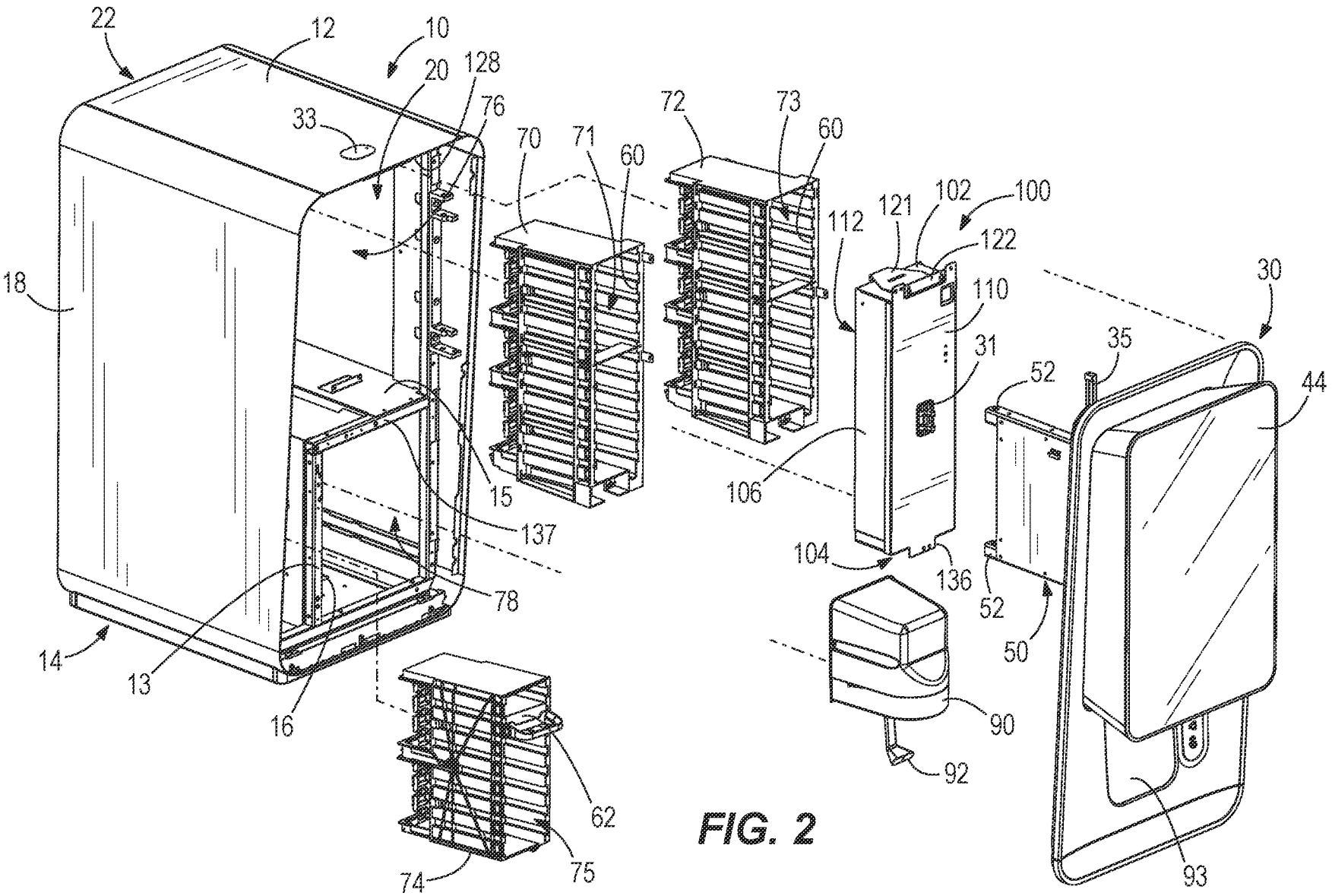
FIG. 2 is an exploded view of FIG. 1.
Figure 3:
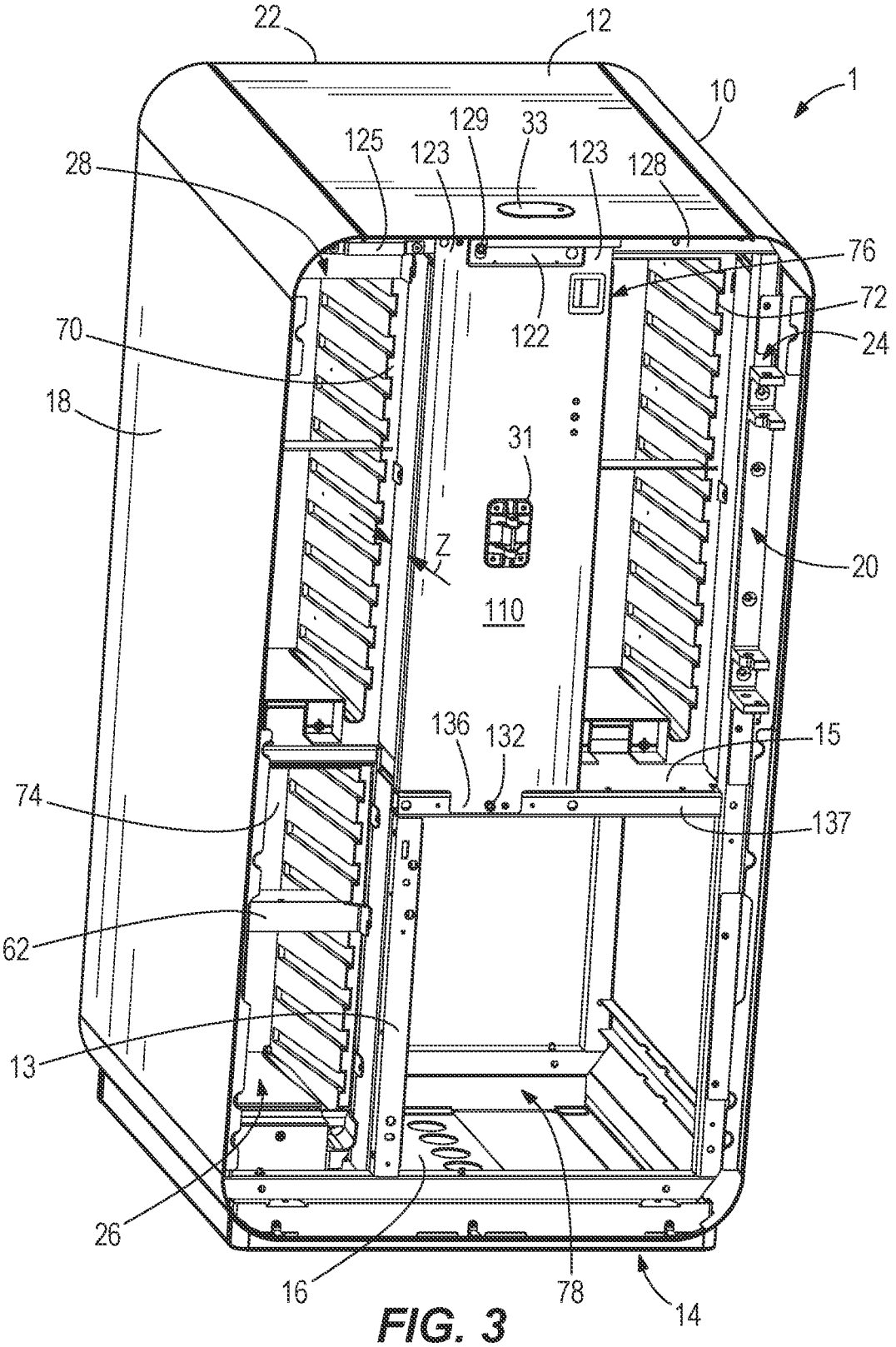
FIG. 3 is a front perspective view of the beverage dispenser of FIG. 1 with the front cover removed.

FIGS. 2-3 show the interior 20 of the cabinet 10. The interior 20 is configured to maximize the number of components able to be contained within the cabinet 10, while also minimizing the physical space required for the beverage dispenser 1. As will become apparent, the presently disclosed beverage dispenser 1 is also designed to provide ease of access to each component within the cabinet 10 for installation, maintenance, and general serviceability.

FIG. 2 depicts a cabinet 10 with the components removed for further discussion. The cabinet 10 includes housings 70, 72, 74 that define respective bays 71, 73, 75, each with cartridge slots 60. The cartridge slots 60 support cartridges 62 containing ingredients for dispensing from the beverage dispenser 1. The cartridges are removably supported within the slots 60 of respective bays 71, 73, 75. In particular, cabinet 10 includes a housing 70 within an upper left region 28 of the interior 20. The housing 70 defines the bay 71. The cabinet 10 includes the housing 72 within an upper right region 24 of interior 20. The housing 72 defines the bay 73. Housing 70 and housing 72 are spaced horizontally apart across the cabinet 10 between the upper left region 28 at the top 12 and at one side 18 and the upper right region 24 at the top 12 and at the other side 18, respectively. The housing 74 is located in a lower left region 26 of the interior 20 and defines a bay 75. The housing 70 and housing 74 are vertically aligned and secured to one another in addition to being secured to the side 18 of the cabinet 10. The housings 70, 72, 74 may be integrally formed with the cabinet 10, or coupled thereto via welding, fasteners, or other techniques known in the art. It should be recognized that greater or fewer numbers of housings are also contemplated by the present disclosure, including positioning the various housings in different regions of the interior 20, and having housings with different numbers of cartridge slots 60 therein.

A cavity 76 is defined within the interior 20 of the cabinet 10 between the housing 70 in the upper left region 28 and the housing 72 in the upper right region 24. The cavity 76 is configured to receive the electronics box 100 therein. The electronics box 100 will be described in further detail herein with respect to FIGS. 5 and 6 and in cross-section in FIG. 11. The electronics box 100 has a top 102 and bottom 104, sides 106, and a front panel 110 and back panel 112. The electronics box 100 may be removably coupled to the cabinet 10 in multiple ways, which is discussed further below. In general, the electronics box 100 contains the circuitry and electronics boards 111 that function to receive power from an external power source and provide power and electrical communication signals to and from various components within the cabinet 10. For example, the circuitry and electronics boards 111 provide low-voltage electrical communications to other electrical components of the system, including but not limited to, the graphical display, user inputs, pumps, valves, and/or RFID readers.

A cavity 78 is defined within the interior 20 of the cabinet below the housing 72 and adjacent the housing 74. In the cabinet 10 shown, the cavity 78 is further defined by an interior wall 13 extending upwardly from the bottom 14 of the cabinet, and a rail 137 coupled between the top of the interior wall 13 and the side 18 of the cabinet 10. The rail 137 supports an interior floor 15, of which the rail 137 may be a part. The interior floor 15 also further defines the cavity 76 and in an example may provide support for the electronics box 100. In examples, the interior floor 15 extends below the housing 72. The housing 72 is secured to the interior floor 15 and the housing 74 is secured to the interior wall 13. The interior wall 13 and interior floor 15 also provides both infiltration protection (e.g., from debris, leaks, and/or falling impacts) for components positioned within the cavity 78, while also providing for fire safety clearance and paths for power and electrical communication connections.

FIG. 3 shows the beverage dispenser 1 of FIG. 2 with the components installed within the cabinet 10. The electronics box 100 is shown in an operational position in which the electronics box 100 is within the cavity 76 between the housing 70 and the housing 72. As shown, when the electronics box 100 is in the operational position, the front panel 110 of the electronics box 100 is within the open interior 20 of the cabinet 10. The front panel 110 of the electronics box 100 includes the striker 31 which is configured to be engaged by the latch 29 of the hinge system 50. Thus the front cover 30 (FIG. 1) is secured in the closed position for standard operation of the beverage dispenser 1 by a physical connection to the electronics box 100 through the hinge system 50.

Because the electronics box 100 serves as the point of contact to secure the front cover 30 to the cabinet 10 in the closed position, the electronics box 100 is rigidly secured to the cabinet 10, but in a way that the electronics box 100 is removable to the service position. A lip 128 of a support frame of the cabinet 10 extends across the open interior 20 of the cabinet 10 between the sides 18 and interior of the top 12. The lip 128 includes features as will be described herein that provide two separate mechanisms for the removable coupling of the electronics box 100 to the cabinet 10 between the operational position and the service position. The lip 128 includes threaded openings 127 at the cavity 76.

The threaded openings 127 are configured to receive fasteners 129 therein. The lip 128 further includes a bracket 125 coupled thereto. While the bracket 125 is depicted as located at the upper left region 28, it will be recognized that in other examples, the bracket 125 may alternatively be located at the upper right region 24. In a still further example, the lip 128 may include a bracket 125 at both locations, which may accommodate flexibility during service and/or a handedness of the service technician. The bracket 125 may be integrally formed with the lip 128 or to another portion of the cabinet 10, or may be coupled thereto using welds, fasteners, and other methods presently known in the art. When in the operational position, the bottom 104 of the electronics box 100 rests on the interior floor 15, and more particularly, rests on the rail 137 that supports the interior floor 15. The front panel 110 of the electronics box 100 further includes a bottom tab 136 that extends beyond the bottom 104 of the electronics box 100. When the electronics box 100 is in the operational position, the tab 136 engages the a rail 137 of the interior floor 15. One or more fasteners 132, exemplarily threaded fasteners, can further secure the tab 136 to the rail 137.

Figure 4:
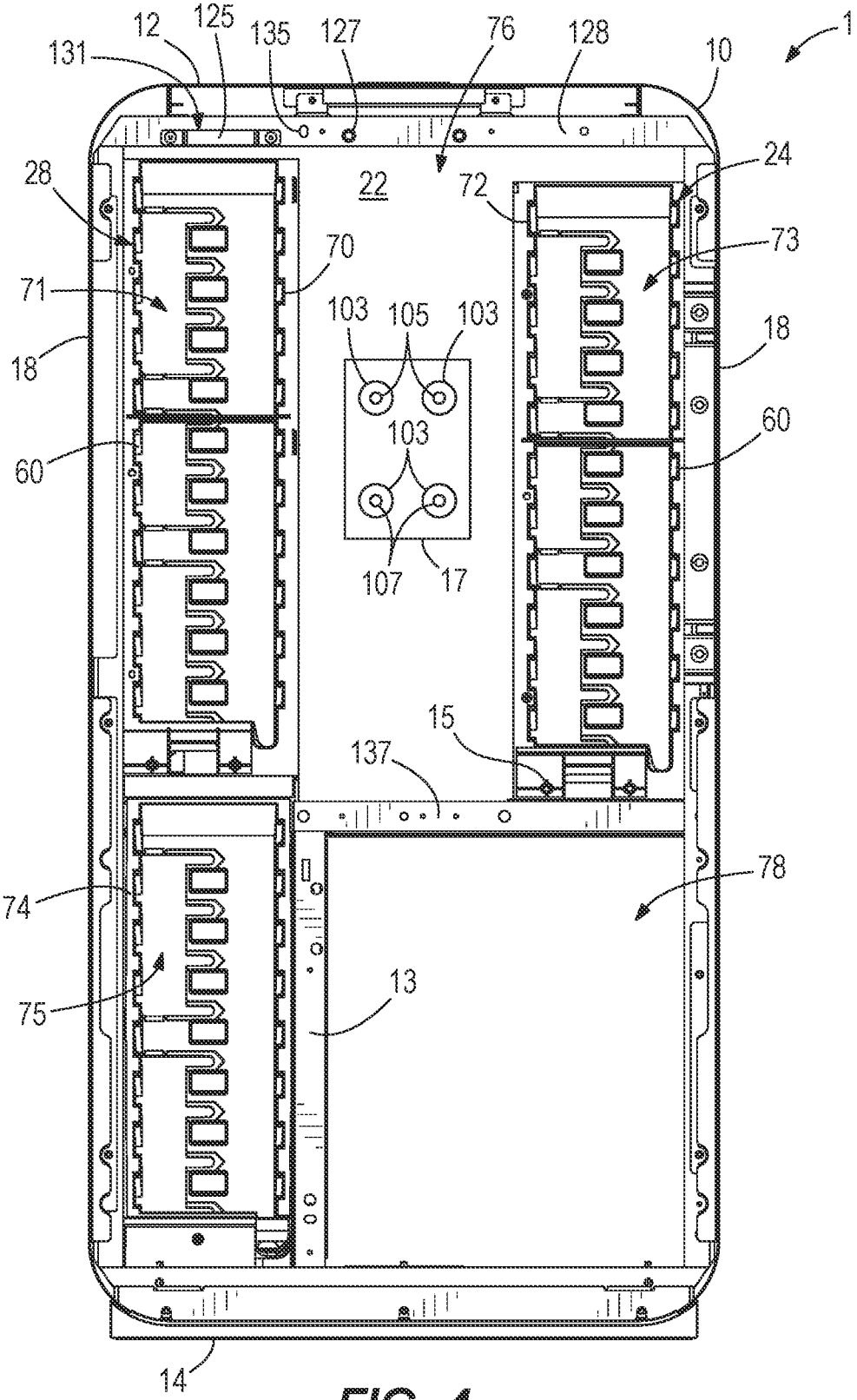
FIG. 4 is a front view of the beverage dispenser of FIG. 3 with an electronics box removed.

FIG. 4 shows a front view of the cabinet 10, with the electronics box 100 removed. With the electronics box 100 removed, a bulkhead 17 can be seen extending forward from the back 22 of the cabinet 10. The bulkhead 17 includes electrical connections 103 through which electrical cables, for example electrical cables 105 carrying high voltage electrical power, for example electrical mains power, and electrical cables 107 carrying low voltage electrical communications extend into the cabinet 10 from outside.

Figure 5:
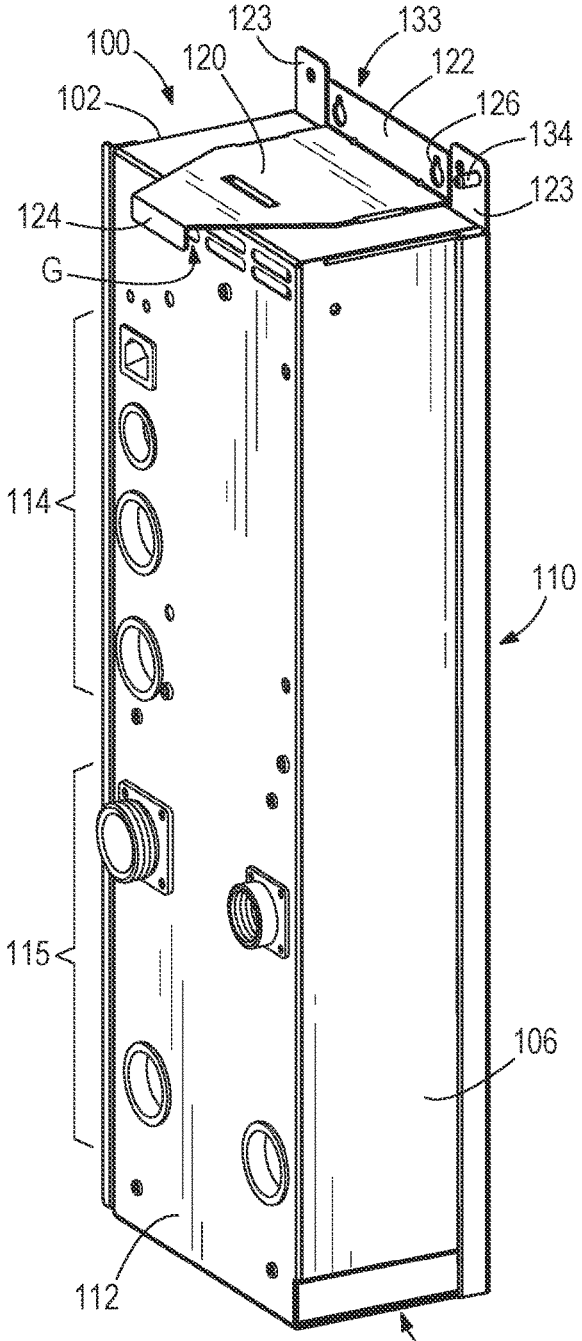
FIG. 5 is a rear perspective view of an electronics box such as shown in FIG. 1.
Figure 6:
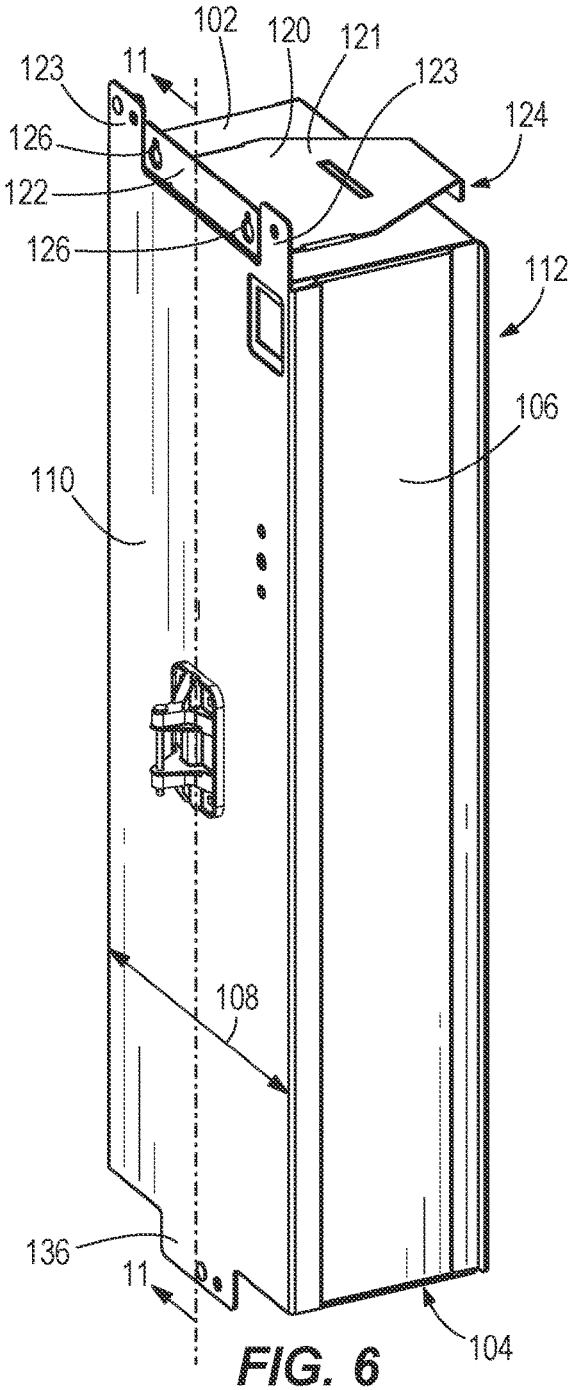
FIG. 6 is a front perspective view of the electronics box of FIG. 5.
Figure 11:
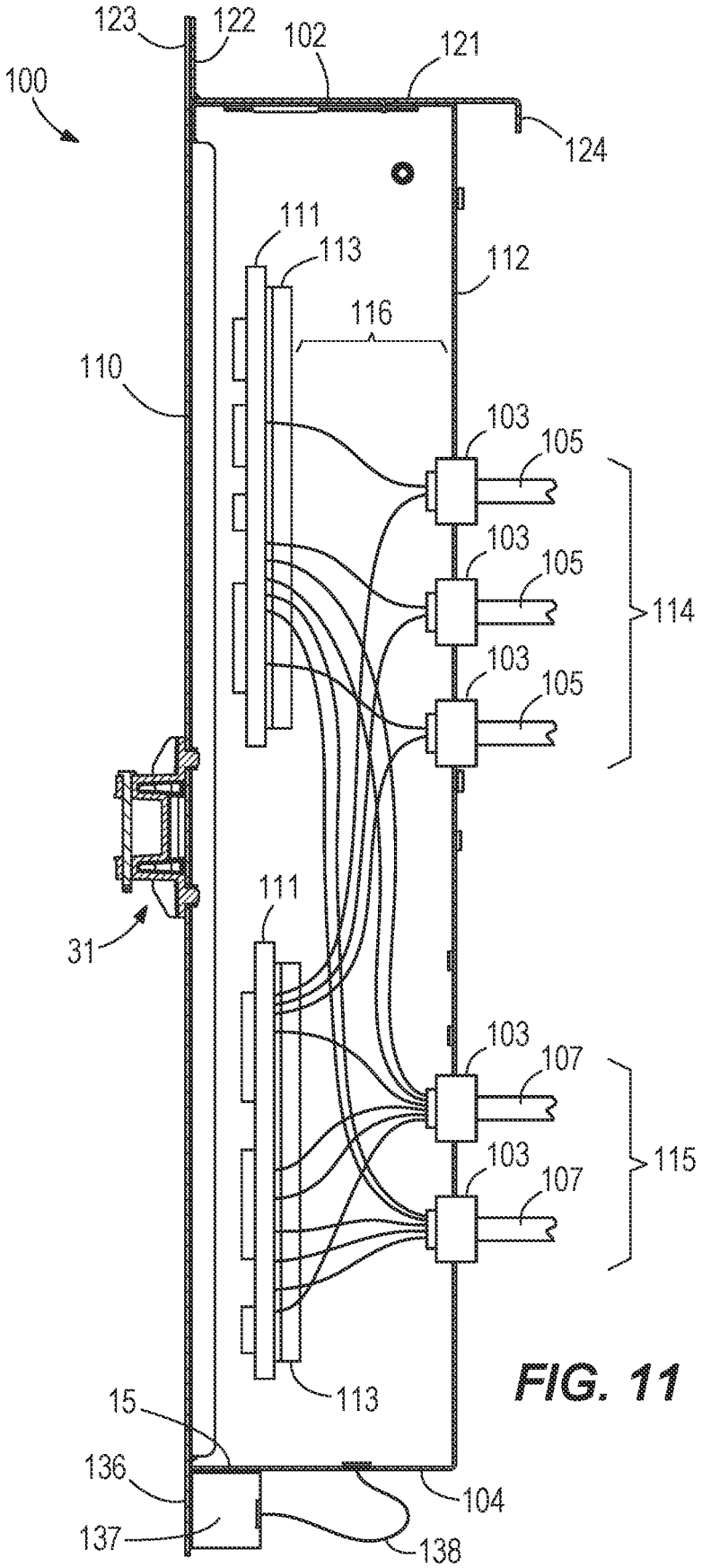
FIG. 11 is a cross-sectional view of the electrical box.

FIGS. 5, 6, and 11 show additional details regarding the electronics box 100 and how it is removably coupled to the cabinet 10 between the operational position and the service position. As discussed above, the electronics box 100 has a top 102 and bottom 104, sides 106, and a front panel 110 and back 112, and which are exemplarily constructed of sheet metal or plastic. The back 112 of the electronics box 100 includes ports 114 for the electrical cables 105 carrying high voltage electrical power and includes ports 115 for the electrical cables 107 carrying low voltage electrical communications into and out of the electronics box 100. The ports 114 and the ports 115, exemplarily further include electrical connections 103. In an example, the electrical connections 103 at the bulkhead 17 and the ports 114 and 115 are strain relief bushings, for example as available from Heyco Products Inc. One or more circuit boards 111, are mounted centrally within the electronics box 100. Mounting brackets 113 exemplarily secure the circuit boards 111 to the sides 106 and/or to the back panel 112, in a location spaced apart from the back panel 112 and the front panel 110. The mounting brackets 113 may further space the circuit boards 111 from the sides 106 as well. The centrally positioned circuit boards 111 enables the harnesses of wiring 116 from the cables 105, 107 to be routed to and from the circuit boards 111 from behind the circuit boards 111, which has been found to improve durable mobility of the electronics box 100 between the operational position and the service position.

A width 108 is defined between sides 106. The width 108 is dimensioned to the cavity 76 between the housing 70 and the housing 72. A bracket 120 is coupled to the top 102 of the electronics box 100. The bracket 120 has a bracket body 121 secured to the top of the 102 of the electronics box 100. A front flange 122 extends upwardly from, and exemplarily perpendicular to, the bracket body 121. The front flange 122 may be inset from the front panel 110 of the electronics box 100. The front panel 110 may include panel extensions 123, between which an aperture 133 is defined, the front flange 122 being exposed through the aperture 133. Openings 126 are defined through the front flange 122, the openings 126 exemplarily having a keyhole shape with a smaller width and a larger width such that a head of a fastener received therethrough prevents removal of the electronics box 100 without first lifting the electronics box upwardly to align the fastener head with the larger width of the opening 126. The keyhole shape, further enables the electronics box 100 to be inserted into the cavity 76 over the fasteners 129, and then lowered into a position resting on the rail 137 of the interior floor 15 before the fasteners 129 and 132 are tightened. The bracket 120 further includes a hook 124 generally opposite the front flange 122. The hook 124 extends rearward of the back 112 of the electronics box, defining a gap G between the hook 124 and the back 112 of the electronics box 100.

Referring back to FIG. 3, the electronics box 100 is shown to be coupled to the cabinet 10 in the operational position, that is, this is the position of the electronics box 100 during normal operation of the beverage dispenser 1, and a position in which the electronics box 100 is inset into the open interior 20 such that the cover 30 can be locked in the closed position by engagement with the striker 31 on the front panel 110 of the electronics box 100. The electronics box 100, with the cables 105, 107 for electrical power and communicative connection extending from the bulkhead 17 to the ports 114 and 115, is further coupled to the cabinet 10 in the operational position by inserting the electronics box 100 into the cavity 76 with the back 112 first. The electrical power and communicative connections, along with a slack length of the cables 105, 107 as described in further detail herein are positioned within the cavity 76 between the back 22 of the cabinet 10 and the back 112 of the electronics box 100. When the electronics box 100 is in the operational position, it is recognized that the electronics box 100 blocks further access to the cavity 76. The front flange 122 is secured to the cabinet 10 by fasteners 129 that extend through the openings 126 in the front flange 122 and are received in the threaded openings 127 (FIG. 4) in the lip 128. Exemplary fasteners include screws and/or bolts, for example. At least one extension 123 of the front panel 110 of the electronics box 100 may further include at least one locating pin 134. The locating pin 134 may further be received within a hole 135 through the lip 128 to assist in alignment and positioning of the electronics box 100 in the operational position for connection to the cabinet 10.

The present inventors have recognized that in the interest of simplifying maintenance for the beverage dispenser 1, it would be advantageous to allow the electronics box 100 to be moved out of the cavity 76 to thereby gain access to other components therein, including the pumps as described in further detail herein without having to electrically disconnect the electronics box 100. Accordingly, the presently disclosed beverage dispenser 1 provides for the electronics box 100 to be moved to a service position without disconnection of the cables 105 and 107 for electrical power and communication. This enables the dispenser to remain in a powered and operational state throughout service or maintenance. The electronics box 100 is removable from the operational position, by removing the fasteners 132, 129, or if the fasteners 129 are not drawn completely tight, by simply lifting the electronics box 100 so that heads of the fasteners 129 can be withdrawn from the larger width at the bottom of the openings 126 in the front flange 122 of the electronics box 100. With the electronics box 100 disengaged from the lip 128 and the interior floor 15, the electronics box 100 can be moved to the service position.

Figure 7:
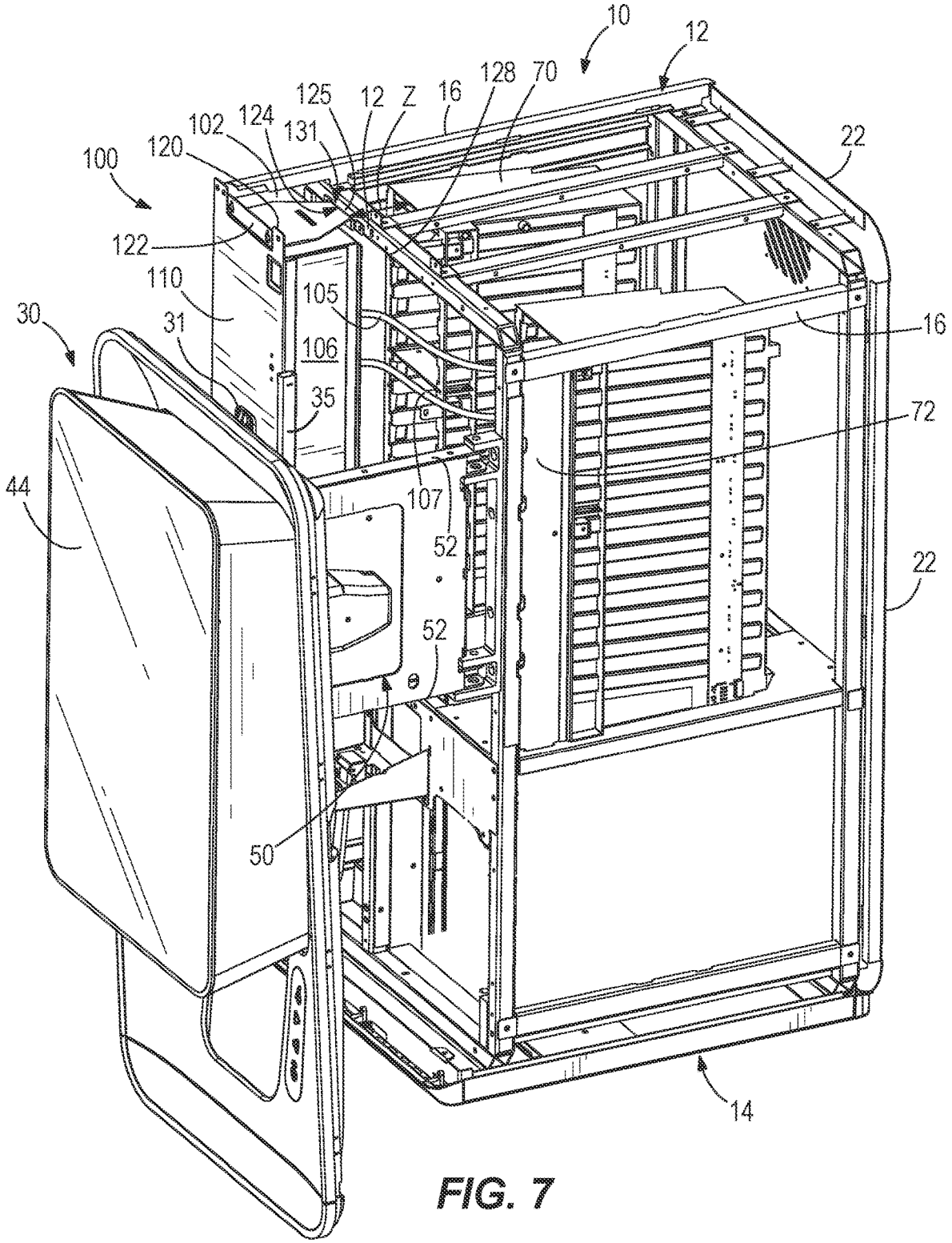
FIG. 7 is a right perspective view of the beverage dispenser of FIG. 1 with a right side of the cabinet removed and an electronics box in a service position.

FIG. 7 shows the electronics box 100 coupled to the cabinet 10 in the service position, exemplarily in front of the housing 70. As discussed above, the bracket 120 coupled to the top 102 of the electronics box 100 includes a hook 124 that extends downwardly from the body 121 of the bracket 120 and spaced apart from the back 112 of the electronics box 100 by a gap G. The hook 124 is configured to be received within a slot 131 formed between the bracket 125 and the lip 128 to which the bracket 125 is secured. The slot 131 and the hook 124 are dimensioned such that the hook 124 is removably received within the slot 131, yet when so received, the hook is securely retained within the slot 131 such that the electronics box is securely supported to hang from the bracket 125. Engagement between the hook and the bracket 125 exemplarily prevents lateral movement of the hook 124 and/or the electronics box 100 as well as prevents further downward movement of the electronics box 100 and limited rotation of the electronics box 100 about the hook 124/bracket 125 interface towards the back 22 of the cabinet 10. Additionally, the housing 70, and exemplarily housing 72 and housing 74 as well, are inset into the open interior 20 by an inset distance Z from the lip 128 of the frame and the rail 137 of the interior floor. This inset distance Z provides a further clearance for the cables 105 and 107 to remain connected to the electronics box 100 in service position as described herein.

As previously noted, the cables 105 and 107 for electrical power and communications, are connected to the back 22 of the cabinet and the back panel 112 of the electronics box 100 with electrical connections 103 which are exemplarily strain relief bushings. The strain relief bushings fixedly secure to the cables 105, 107 and to wall (e.g. back panel 112 or back 22) through which the cables 105, 107 extend. The strain relief bushings therefore create a point of fixed relationship against translation, twisting, or bending of the cables 105, 107 relative to the respective walls. With these fixed points at the back panel 112 and the back 22, the slack length of the cables 105, 107 can be defined to adequately provide the cable length to reposition the electronics box 100 in the service position. That is, the lengths of the cables 105, 107 are defined based upon the electronics box in the service position. Because of the fixed points provided by the connections 103, the length of the cables can be defined and maintained as the electronics box 100 is moved from the operational position to the service position without disconnection of the electrical power and communicative connections from the electronics box 100. Since the dispenser disclosed herein is intended to be capable of electrical operation during service, the electronics box 100 is further provided with an electrical ground 138 between the electronics box 100 and the body of the dispenser 1, exemplarily the rail 137 of the interior floor 15. The electrical ground is further provided with a suitable flexibility and slack length such that the electrical ground 138 maintains connection between the electronics box 100 and the cabinet 10 at all times as the electronics box is moved between the operational and service positions.

In this manner, the electronics box 100 may be removed from its operational position in front of the cavity 76 and temporarily hung by virtue of the hook 124 hanging on the bracket 125 in the service position to provide access to the cavity 76.

It should be recognized that other engagement features may be used to retain the electronics box 100 within the cavity 76, or in alternative service positions, for example in front of the housing 72. In still further examples, multiple brackets 125 may be provided at various locations to give optionality to the service position of the electronics box 100 used by a technician. The configuration of FIG. 7 provides an advantage by separating the service position of the electronics box 100 from the hinge system 50, such that the front cover 30 is movable in a direction away from the service position of the electronics box 100, facilitating improved access to the interior 20 of the cabinet 10.

Figure 8:
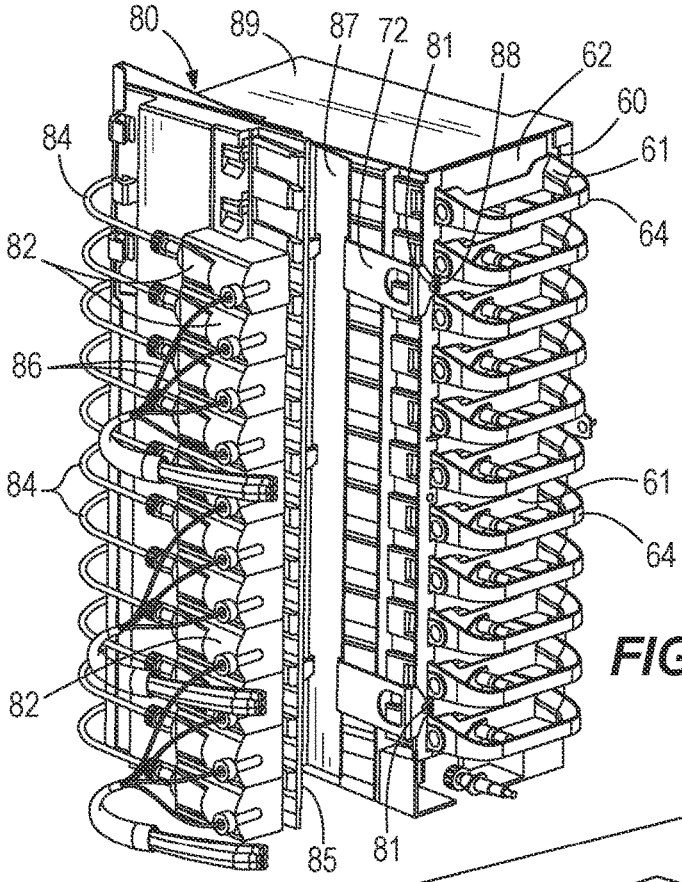
FIG. 8 is front perspective view of an upper right housing from FIG. 1 along with cartridges, a pump bracket, and accessories coupled therewith.
Figure 9:
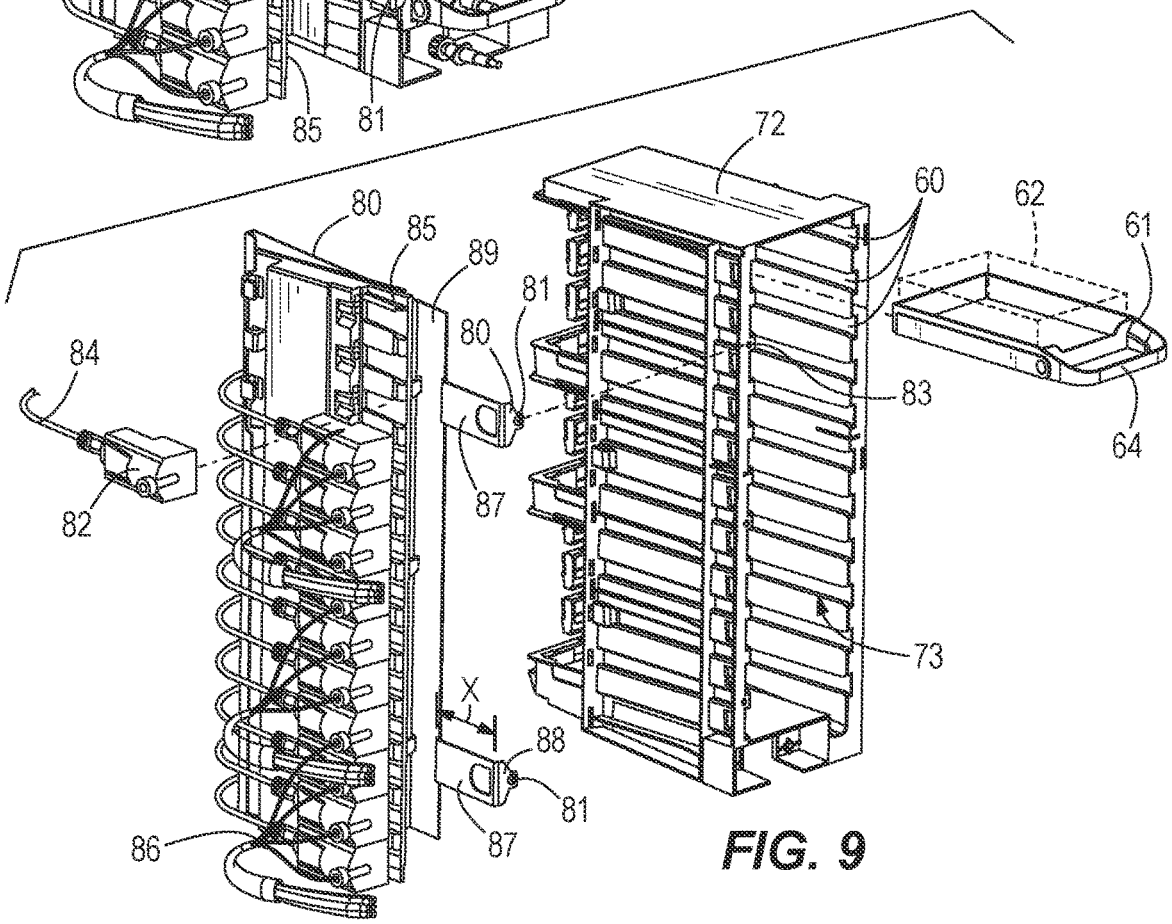
FIG. 9 is an exploded view of FIG. 8.

As previously discussed, the cabinet 10 provides a plurality of cartridge slots 60 for supporting cartridges 62 containing ingredients for dispensing beverages, for example concentrated ingredients used for "micro-dosing" applications. As shown in FIGS. 8 and 9, the cartridges 62 may be supported by trays 61 having handles 64 in a manner known in the art (e.g. within Coca-Cola® Freestyle machine) such that the cartridges 62 may be installed within cartridge slots 60.

FIGS. 8 and 9 show a housing separate from the cabinet 10, exemplarily the housing 72, although it will be recognized that the features described herein may similarly be applied to examples of housing 70 and housing 74. The housing 72 receives a plurality of trays 61 each containing a cartridge 62 of flavoring, the trays received within the cartridge slots 60 within the bay 73. FIG. 8 shows the housing 72 loaded with a plurality of trays 61 each containing a cartridge 62. FIG. 9 depicts the housing 72 in an exploded view showing a single tray 61 and a cartridge 62 in phantom. Each of the trays 61 includes a handle 64 to facilitate removal and replacement of the of the cartridges 62. The ingredients within the cartridges 62 are provided for dispending via pumps 82, in this case with each cartridge 62 having its own corresponding pump 82 in a 1:1 ratio. Each pump 82 is coupled to a cartridge via an input line 84, and also via output lines 86 to dispensing hardware for dispensing in a customary manner. The output lines 86 may communicate with a nozzle directly or, for example, through a multi-flavor valve, such is provided in the Cornelius® IDC PRO, or a combination thereof. Additional information regarding an exemplary multi-flavor valve can be found in U.S. Pat. No. 9,656,849.

Pump brackets 80 as presently disclosed facilitate servicing of the pumps 82, including connections to the input lines 84 thereto and output lines 86 therefrom, entirely from the front of the beverage dispenser. As shown in FIGS. 8 and 9, the pump bracket 80 has a bracket plate 89 and a bracket body 85. The bracket plate 89 is exemplarily constructed of sheet metal. The bracket body 85 is exemplarily constructed of a V-0 rated plastic. The pumps 82 are each connected to the bracket body 85 by press-fit engagement, fasteners, or other methods known in the art. The bracket body 85 is secured to and generally spaced apart from the bracket plate 89, such as to define a flame enclosure for a control board (not depicted) associated with the operation of the pumps 82.

The pump bracket 80 is secured to an interior side of the housing 72. That is, the pump bracket 80 is located in a direction towards the interior 20 of the cabinet 10 from the housing 72. While housing 72 is depicted in FIGS. 8 and 9, it will be recognized that this feature similarly applies to the pump brackets used with the housing 70 and housing 74, respectively. As will be described in further detail herein, this positions the pumps 82 within the cavity 76 in the case of housings 70 and 72. This further positions the pumps 82 within the cavity 78 in the case of housing 74. The pump bracket 80 has mounting arms 87 that extend forward from the bracket plate 89. End tabs 88 extend perpendicularly from the mounting arms 87. In an example, the mounting arms 87 and the end tabs 88 are a unitary construction with the bracket plate 89. In other examples, the mounting arms 87 and the end tabs 88 are separate components connected to the bracket plate 89. Fasteners 81 extend through the end tabs 88 to secure the pump bracket 80 to the housing 72. The relation of the end tabs 88 to the housing 72 enable the fasteners to be connected through the end tabs 88 to the housing 72 from the front of the cabinet 10. The fasteners 81 may be screws or bolts engaged within threaded openings 83 in the front of the housing 72. In this manner, after servicing the pumps 82, all pumps 82 returned to the cabinet and be simultaneously coupled thereto, here to the housing 72. The inventors have recognized that it is advantageous for this fastener 81 to be inserted from the front of the housing 72, as coupling to the side thereof would be challenging due to space and lighting constraints of working within the cavity 76 (see FIG. 4), especially with screwdrivers and the like. This design also eliminates the risk of dropping screws or other fasteners within the cabinet, which results in additional downtime or a risk of electrical shorting if unrecovered.

The mounting arms 87 extend for a length X such that when the end tabs 88 are secured to the housing 72, the bracket body 85 and the pumps 82 are inset into the interior 20 of the cabinet 10 by the length X. That is, that the pumps 82 and the bracket body 85 are positioned towards the back 22 of the cabinet 10. This inset creates room within the cavity 76 between housing 70 and housing 72 for the electronics box 100 in the operational position (shown in FIG. 3). Therefore, the length X is sufficient to position the pumps 82 fully behind the back 112 of the electronics box 100, when the electronics box 100 is in the operational position. In examples wherein the housing 72 is inset by a distance Z as described above, it will be recognized that it is the length X+Z that positions the pumps 82 behind the back panel 112 of the electronics box 100. For example, the depth of the sides 106 of the electronics box 100 is equal to or less than length X+Z. This provides an improved utilization of space within the cabinet 10, yet remains fully serviceable from the front by moving the electronics box 100 to the service position (shown in FIG. 7) as discussed above. In the case of the housing 74, the associated pump bracket 80 and arms 87 as described above, insets the pumps 82 towards the back 22 of the cabinet 10 in a similar manner, although positioning the pumps 82 behind the interior wall 13. This further positions the pumps 82 in the cavity 78 behind the dispensing hardware 90.

In this manner, by swinging the front cover 30 open to a desired position via the front pivot axis FPA and rear pivot axis RPA provided by the hinge system 50, an operator is able to provide service or installation needs for any of the cartridges retained within the cartridge slots 60 of the any of the housings 70, 72, or 74. During movement of the front cover 30 from the closed position to the open position, the hinge system 50 enables the graphical display 44 to remain facing the operator. Since the electronics box 100 enables the power and communications to remain connected during servicing, the graphical display 44 can remain operational and functional to the operator during service. Likewise, access is provided to the electronics box 100 whether positioned within the cavity 76, or positioned adjacently, such as in front of the housing 70 as discussed above.

This written description uses examples to disclose the invention, including the best mode, and also to enable any person skilled in the art to make and use the invention. Certain terms have been used for brevity, clarity, and understanding. No unnecessary limitations are to be inferred therefrom beyond the requirement of the prior art because such terms are used for descriptive purposes only and are intended to be broadly construed. The patentable scope of the invention is defined by the claims and may include other examples that occur to those skilled in the art. Such other examples are intended to be within the scope of the claims if they have features or structural elements that do not differ from the literal language of the claims, or if they include equivalent features or structural elements with insubstantial differences from the literal languages of the claims.

What is claimed is:

1. A beverage dispenser configured to be serviced from a front thereof, the system comprising:

a cabinet having a top opposite a bottom, a back that extends between the top and the bottom, and sides extending forwardly from the back between the top and the bottom, wherein an interior is defined between the top, the bottom, the back, and the sides;

a front cover coupled to the cabinet and positionable in an open position and a closed position opposite the back of the cabinet;

an interior floor within the cabinet, the interior floor comprising a rail;

a frame comprising a lip that extends between the sides of the cabinet proximate the top of the cabinet;

a housing positioned in the interior, the housing configured to receive a plurality of cartridges containing ingredients for a beverage, the housing within the interior at least partially defining a cavity within the cabinet;

an electronics box housing electrical circuitry, the electronics box coupled to the cabinet in a operational position at least partially within the cavity and wherein the electronics box is coupled to the cabinet in a service position in front of the housing; and a bracket mounted to a top of the electronics box, the bracket comprising a flange that extends upwardly from the top of the electronics box and the bracket comprising a hook that extends rearward past a back of the electronics box;

wherein when the electronics box is in the operational position, a bottom of the electronics box rests upon the interior floor and the electronics box is removably secured to the rail by a first fastener and removably secured to the lip by at least a second fastener through the flange.

2. The beverage dispenser according to claim 1, further comprising a bracket secured to the lip at a position in front of the housing, wherein when the electronics box is in the service position, the hook releasably secures the electronics box to the bracket secured to the lip.

3. The beverage dispenser according to claim 1, further comprising:

first electrical connectors through the cabinet wherein at least an electrical power cord and an electrical communication cord enter the cabinet through the first electrical connectors; and second electrical connectors through the electronics box wherein at least the power cord and the electrical communication cord enter the electronics box through the second electrical connectors.

4. The beverage dispenser according to claim 3, wherein the first and second electrical connectors are strain relief bushings.

5. The beverage dispenser according to claim 4, wherein the first and second electrical connectors provide fixed points relative to the electrical power cord and the electrical communication cord, and respective lengths of the electrical power cord and the electrical communication cord are defined based upon the distance between the first and second electrical connectors when the electronics box is in the service position.

6. The beverage dispenser according to claim 4, further comprising an electrical grounding wire connected between the electronics box and the cabinet wherein the grounding wire remains connected between the electronics box and the cabinet as the electronics box is moved between the operational position and the service position.

7. A beverage dispenser configured to be serviced from a front thereof, the system comprising:

a cabinet having a top opposite a bottom, a back that extends between the top and the bottom, and first and second sides extending forwardly from the back between the top and the bottom, wherein an interior is defined between the top, the bottom, the back, and the first and second sides;

a front cover coupled to the cabinet and positionable in an open position and a closed position opposite the back of the cabinet;

a first housing positioned in the interior adjacent the first side and the top, the first housing configured to receive a plurality of ingredient cartridges;

a second housing positioned in the interior adjacent the second side and the top, the second housing configured to receive the plurality of ingredient cartridges, wherein the first housing and the second housing at least partially define a cavity within the interior;

an interior floor comprising a rail supported between an interior wall and at least one of the first side or the second side;

a hinge system connected between the cabinet and the front cover and operates to move the front cover between the open position and the closed position, the hinge system comprising a latch; and an electronics box having a front panel and a back panel and housing electrical circuitry, the electronics box configured to couple to the cabinet in an operational position at least partially within the cavity and supported by the rail and wherein the electronics box is configured to couple to the cabinet in a service position in front of the first housing, wherein the front panel comprises a striker configured to be engaged by the latch of the hinge system to removably secure the front cover in the closed position.

8. The beverage dispenser of claim 7, wherein the hinge system comprises two arms connected by an arm body the two arms each movably extend between the cabinet and the front cover.

9. The beverage dispenser according to claim 8, wherein the front panel further comprises a graphical display, and front panel is configured to remain parallel to the closed position as the front panel moves from the closed position to the open position.

10. The beverage dispenser according to claim 7, further comprising a first pump bracket and a second pump bracket each configured to connect to a plurality of pumps configured to fluidly connect to the plurality of ingredient cartridges;

wherein the first pump bracket comprises at least one first arm extending forward of the first pump bracket and configured to secure to the first housing, the first pump bracket interior the cabinet from the first pump bracket, wherein the first pump bracket positions the plurality of pumps connected to the first pump bracket behind the back panel of the electronics box when the electronics box is in the operational position; and wherein the second pump bracket comprises at least one second arm extending forward of the second pump bracket and configured to secure to the second housing, the second pump bracket interior the cabinet from the first pump bracket, wherein the first pump bracket positions the plurality of pumps connected to the second pump bracket behind the back panel of the electronics box when the electronics box is in the operational position.

11. The beverage dispenser according to claim 10, wherein the first housing and the second housing are positioned within the interior inset from the rail, wherein when the electronics box is in the operational position, the front panel of the electronics box is forward of the first housing and the second housing.

12. The beverage dispenser according to claim 11, further comprising:

a frame comprising a lip that extends between the first and second sides of the cabinet at the top of the cabinet, the frame comprising a frame bracket in front of the first housing;

a bracket mounted to a top of the electronics box, the bracket comprising a flange that extends upwardly from the top of the electronics box and a hook that extends rearward from the back of the electronics box; and wherein the electronics box is configured to connect in the operational position by at least a first fastener through the flange and into the lip and the configured to connect in the service position by engagement between the hook and the frame bracket.

13. The beverage dispenser of claim 7, further comprising:

first electrical connectors through the cabinet wherein at least an electrical power cord and an electrical communication cord enter the cabinet through the first electrical connectors; and second electrical connectors through the electronics box wherein at least the power cord and the electrical communication cord enter the electronics box through the second electrical connectors;

wherein the first and second electrical connectors are strain relief bushings that provide fixed points relative to the electrical power cord and the electrical communication cord, and respective lengths of the electrical power cord and the electrical communication cord are defined based upon a distance between the first and second electrical connectors when the electronics box is in the service position.

14. The beverage dispenser according to claim 13, further comprising an electrical grounding wire connected between the electronics box and the cabinet wherein the grounding wire remains connected between the electronics box and the cabinet as the electronics box is moved between the operational position and the service position.

15. A beverage dispenser configured to be serviced from a front thereof, the system comprising:

a cabinet having a top opposite a bottom, a back that extends between the top and the bottom, and sides extending forwardly from the back between the top and the bottom, wherein an interior is defined between the top, the bottom, the back, and the sides;

a front cover coupled to the cabinet and positionable in an open position and a closed position opposite the back of the cabinet;

a housing positioned in the interior, the housing configured to receive a plurality of cartridges containing ingredients for a beverage, the housing within the interior at least partially defining a cavity within the cabinet;

an electronics box configured to house electrical circuitry, the electronics box comprising a front panel with a striker secured to the front panel, the electronics box coupled to the cabinet in an operational position at least partially within the cavity and wherein the electronics box is coupled to the cabinet in a service position in front of the housing.

16. The beverage dispenser according to claim 15, further comprising a hinge system that operates to move the front cover between the open position and the closed position, wherein the hinge system comprises two arms connected by an arm body the two arms each movably extend between the cabinet and the front cover, and a latch, wherein the latch is configured to releasably secure the front cover to the striker on the front panel of the electronics box when the front cover is in the closed position.

17. The beverage dispenser according to claim 15, further comprising:

an interior floor comprising a rail and when the electronics box is in the operational position, a bottom of the electronics box rests upon the interior floor; and a frame comprising a lip that extends between the sides of the cabinet at the top of the cabinet;

wherein when the electronics box is in the operational position, the electronics box is removably secured to the rail by a first fastener and the electronics box is removably secured to the lip by at least a second fastener.

18. The beverage dispenser according to claim 17, further comprising:

a bracket mounted to a top of the electronics box, the bracket comprising a flange that extends upwardly from the top of the electronics box and the bracket further comprises a hook that extends rearward past a back of the electronics box;

wherein the second fastener secures the electronics box to the lip through the flange.

19. The beverage dispenser according to claim 15, further comprising:

first electrical connectors through the cabinet wherein at least an electrical power cord and an electrical communication cord enter the cabinet through the first electrical connectors; and second electrical connectors through the electronics box wherein at least the power cord and the electrical communication cord enter the electronics box through the second electrical connectors.

20. The beverage dispenser according to claim 19, further comprising:

an electrical grounding wire connected between the electronics box and the cabinet wherein the grounding wire remains connected between the electronics box and the cabinet as the electronics box is moved between the operational position and the service position;

wherein the first and second electrical connectors provide fixed points relative to the electrical power cord and the electrical communication cord, and respective lengths of the electrical power cord and the electrical communication cord are defined based upon the distance between the first and second electrical connectors when the electronics box is in the service position.

* * * * *